US005251606A

United States Patent [19]

Colvin

[11] Patent Number: 5,251,606

[45] Date of Patent: Oct. 12, 1993

[54] MICRO-ADJUST ARROW STABILIZING ASSEMBLY

[75] Inventor: Richard O. Colvin, Baldwinsville, N.Y.

[73] Assignee: Kinetronic Industries, Inc., Media, Pa.

[21] Appl. No.: 757,815

[22] Filed: Sep. 11, 1991

[51] Int. Cl.[5] ..... F41B 5/22

[52] U.S. Cl. ..... 124/44.5; 124/24.1

[58] Field of Search ..... 124/24.1, 44.5

[56] References Cited

U.S. PATENT DOCUMENTS

| | | | |
|---|---|---|---|
| 2,998,811 | 9/1961 | Sackmann | 124/24.1 |
| 3,059,631 | 10/1962 | Yasho . | |
| 3,482,563 | 12/1969 | Pint | 124/24.1 |
| 3,865,096 | 2/1975 | Troncoso, Jr. | 124/24.1 |
| 3,935,854 | 2/1976 | Troncoso, Jr. | 124/24.1 |
| 4,119,078 | 10/1978 | Wilson et al. | 124/44.5 |
| 4,170,980 | 10/1979 | Killian | 124/44.5 |
| 4,236,497 | 12/1980 | Troncoso, Jr. | 124/24.1 |
| 4,332,232 | 6/1982 | Troncoso, Jr. | 124/24.1 |
| 4,380,226 | 4/1983 | Saunders | 124/44.5 |
| 4,398,528 | 8/1983 | Troncoso, Jr. | 124/24.1 |
| 4,421,092 | 12/1983 | Christian | 124/44.5 |
| 4,476,846 | 10/1984 | Carville | 124/44.5 |
| 4,489,704 | 12/1984 | Troncoso, Jr. | 124/24.1 |
| 4,542,731 | 9/1985 | Quartino | 124/24.1 |
| 4,569,325 | 2/1986 | Christian | 124/44.5 |
| 4,592,332 | 6/1986 | Topping | 124/44.5 |
| 4,598,688 | 7/1986 | Paul et al. | 124/44.5 |
| 4,648,376 | 3/1987 | Saunders | 124/44.5 |
| 4,664,093 | 5/1987 | Nunemaker | 124/24.1 |
| 4,686,956 | 8/1987 | Troncoso, Jr. | 124/44.5 |
| 4,703,745 | 11/1987 | Hammond | 124/44.5 |
| 4,715,355 | 12/1987 | Lattig | 124/44.5 |
| 4,732,135 | 3/1988 | Simo | 124/44.5 |
| 4,748,964 | 6/1988 | Troncoso, Jr. | 124/44.5 |
| 4,756,295 | 7/1988 | Guzzetta | 124/16 |
| 4,809,670 | 3/1989 | Simo | 124/44.5 |
| 4,827,895 | 5/1989 | Troncoso, Jr. | 124/44.5 |
| 4,838,237 | 6/1989 | Cliburn | 124/44.5 |
| 4,865,007 | 9/1989 | Saunders | 124/44.5 |
| 4,890,596 | 1/1990 | Barlow | 124/44.5 |
| 4,947,823 | 8/1990 | Larson | 124/44.5 |
| 4,953,521 | 9/1990 | Troncoso et al. | 124/24.1 |
| 5,031,601 | 7/1991 | Gunter | 124/44.5 |
| 5,070,855 | 12/1991 | Troncoso | 124/44.5 |

OTHER PUBLICATIONS

"Bowhunters Warehouse", pp. 37 and 38 (catalog, no date).

"Cabela's", Autumn 1989, p. 131.

"Bow and Arrow", Jun. 1982, p. 41.

*Primary Examiner*—Randolph A. Reese

*Assistant Examiner*—John Ricci

*Attorney, Agent, or Firm*—D. Peter Hochberg; Mark Kusner; Michael Jaffe

[57] ABSTRACT

An adjustable arrow rest for an archery bow in association with an adjustable arrow-cushion plunger. The arrow rest is adjustable in both horizontal and vertical planes, while the cushion plunger is horizontally adjustable. The arrow rest includes a pivotal support arm having a free end at right angles to a fixed end, the fixed end being laterally adjustable relative to the bracket mounting it to the cushion plunger. Lateral adjustment of the arm is accomplished by means of a spacer disc attached to the arm which can be moved by an adjustment nut in the spacer disc engaged on a threaded stud anchored to the bracket. Vertical movement is controlled by a setscrew which adjusts the support arm's pivot arc. The cushion plunger comprises a plunger rod slidably secured by a threaded fastener in a sleeve which anchors the bracket to the bow. Rotation of the fastener by a tool inserted thereinto through one end of the sleeve determines the extent to which the rod extends from the sleeve's other end, and therefore, the rod's distance from the arrow which it stabilizes.

28 Claims, 3 Drawing Sheets

MICRO-ADJUST ARROW STABILIZING ASSEMBLY

TECHNICAL FIELD

This invention relates to an improved archery equipment assembly that provides more accurate and consistent shooting. More particularly, this invention relates to an arrow rest and to an associated cushion plunger for an archery bow that dampen distortions imposed on arrows during their launch from the bow. Specifically, this invention relates to an arrow rest for an archery bow, and to an associated cushion plunger, both of which can be precisely adjusted to compensate for variables that could otherwise detrimentally affect shooting accuracy.

BACKGROUND OF THE INVENTION

Modern archery has evolved to the point where shooting accuracy approaching that attainable with firearms is possible, especially at short to medium ranges. It is, for example, common for a proficient shooter to consistently place arrows in a three-inch grouping at a range of sixty yards. That such shooting accuracy and consistency is now possible is a testimonial not only to the relatively high degree of skill possessed by many of those seriously interested in the sport of archery, but particularly to the sophistication of archery equipment that has been developed over the years.

In this regard, for example, development of the compound bow now enables shooters to maintain a bow in a fully drawn position with but little expenditure of energy. This ability minimizes muscle strain tremor and permits the shooter's attention to be concentrated exclusively on aiming of the bow, with no fatigue-induced distractions.

In addition, improved sighting devices of various types now available to archery enthusiasts allow vastly improved aiming of the bow with a concomitant influence on shooting accuracy.

Other aids to the sport include arrow rest devices fastened to bow handles which provide support for arrows placed thereon, and which serve to dampen the influence of forces imposed on the arrows by the bow string during the process of arrow launching. Such rests commonly consist of support arms of various shape, positioned generally parallel to the longitudinal axis of arrows placed thereon. Some such rests are spring-loaded in order to provide a restorative force which restrains arrow deflection during the launch. In this regard, at the moment of release of an arrow, the force imposed by the bow string tends to bend the arrow, causing it to bow along both its longitudinal, horizontal and vertical axes. In co-pending application Ser. No. 524,219, filed May 4, 1990, for example, an arrow rest is described which, among other things, permits the adjustment of a vertical restorative force to match the type of arrow being employed, thereby optimizing shooting results over a range of conditions.

In addition to the preceding, a spring-loaded device, referred to as a "cushion plunger" is frequently disposed against one side of an arrow positioned on a rest, thereby furnishing a lateral biasing force that promotes stability of the arrow in the horizontal plane. In this regard, the cushion plunger dampens the arrow's tendency to bend in the horizontal direction as a result of the bow string-imposed forces referred to.

While the arrow rest and cushion plunger devices described exert a salutary effect on shooting accuracy, and are widely used as a consequence, in some respects they tend to be difficult to modify to accommodate changing shooting conditions. With respect to this need, external, uncontrollable influences such as, for instance, temperature and humidity changes, often have an affect on archery equipment. While the changes are not dramatic in terms of magnitude, they can have a quite serious affect on shooting results. In addition, a shooter's physical and mental condition are not immune from day-to-day changes which produce variations in shooting form. Both such affects require compensation of one type or another if shooting accuracy is to be consistently maintained.

Although a variety of methods for compensating for the variables described are available to shooters, some of these require aiming adjustments of a type that are dependent upon physical adaptations, for example, changes in shooting stance. It will be readily appreciated that such changes are difficult to consistently reproduce. Other compensations involve equipment adjustments of a type forbidden in tournament matches, for example, adjustment of a bow's sighting apparatus.

BRIEF DESCRIPTION OF THE INVENTION

In view of the foregoing, therefore, it is a first aspect of this invention to provide associated devices for an archery bow that enhance shooting accuracy and consistency.

It is a second aspect of this invention to provide an improved arrow rest and cushion plunger combination for an archery bow.

Another aspect of this invention is to provide an improved arrow rest and a cushion plunger for an archery bow to which fine adjustments can be made without extensive rearrangement of bow accessory components.

It is an additional aspect of this invention to provide an improved arrow rest and cushion plunger that are rapidly and easily adjusted to suit shooting conditions.

It is a further aspect of this invention to provide an improved arrow rest for a bow that permits small lateral adjustments to be made thereto with precision.

Another aspect of this invention is to provide an improved arrow rest for a bow that also allows fine vertical adjustments to be made thereto.

An additional aspect of this invention is to provide a cushion plunger for a bow that permits precise lateral adjustments to be made thereto.

The preceding and additional aspects of the invention are provided by an adjustable, arrow-launch-stabilizing combination for an archery bow comprising an arrow rest device, together with a cushion-plunger device. The arrow-rest device comprises an arrow support arm having a free end and a fixed end, the free end being positioned at an angle to the fixed end and pivotable through an arc. The fixed end is interconnected with spacer means and torquing means, the spacer means being adapted to adjust the lateral position of the free end relative to the torquing means. The torquing means exerts an adjustable biasing force on the fixed end and is attached to mounting means adapted to fasten the arrow rest device to the cushion plunger device.

The cushion-plunger device comprises an elongated rod having a first end slidably and non-rotatably enclosed within a hollow sleeve, and a second end extending therefrom. The sleeve is adapted to fasten the mounting means to the bow, with the first end of the rod extending into a partition within the sleeve, being held there by a threaded fastener. The sleeve has an open end through which the second end extends, and a substantially closed end which provides access therethrough to a tool for rotating the fastener, rotation providing longitudinal adjustment of the rod relative to the sleeve. Spring means are positioned between the closed end and the fastener, biasing the fastener and urging the second end of the rod from the sleeve.

The preceding and other aspects of the invention are provided by an adjustable arrow rest device for an archery bow comprising an arrow support arm having at least one free end and a fixed end. The free end is positioned at an angle to the fixed end and is pivotal through an arc, the fixed end being interconnected with spacer means and with torquing means.

The spacer means is adapted to adjust the lateral position of the free end relative to the torquing means, the torquing means exerting an adjustable biasing force on the fixed end and being attached to mounting means adapted to fasten the arrow rest to the bow.

The preceding and further aspects of the invention are provided by an adjustable arrow rest device for an archery bow comprising an arrow support arm having a fixed end and two free ends positioned at an angle to the fixed end and pivotable through an arc thereabout.

The device has a bracket adapted to connect it to the bow, and the fixed end is interconnected with a spacer disc, and also to torquing means comprising a bushing into which the fixed end of the support arm passes, and to which it is connectable. The bushing passes through the bracket and is adjustably rotatable therein through an arc.

The bushing further extends into a hollow knob to which it is adjustably connected, a spring being positioned in an annular space between the knob and the bushing with one of its ends being anchored in the bracket and the other in the knob. The bushing is provided with a shoulder having a stud extending from one side thereof into an opening in the bracket, movement of the stud in the opening being adjustably limited by a setscrew extending thereinto, thereby controlling the extent of the arc. The shoulder has two additional studs, one being threaded, extending from the other side of the shoulder.

The fixed end passes through the center of the sides of the spacer disc, to which it is connectable, with the two studs also passing through the sides. The threaded stud engages a support arm lateral-position-adjustment nut recessed in the edge of the disc.

The preceding and still additional aspects of the invention are provided by a cushion-plunger device for an archery bow comprising an elongated rod having a first end slidably and non-rotatably enclosed within a hollow sleeve, and a second end extending therefrom. The sleeve is adapted to pass through the bow and to mount the device thereto. The first end extends into a partition within the sleeve, being held therein by a threaded fastener, rotation of the fastener providing longitudinal adjustment of the rod.

The sleeve has an open end through which the second end of the rod extends and a substantially closed end which provides access to a tool for rotation of the fastener. Spring means are provided between the closed end and the fastener which serves to bias the fastener, urging the second end of the rod from the sleeve.

The preceding and yet other aspects of the invention are provided by a cushion-plunger device for an archery bow comprising a hollow sleeve having a partition therein with a polygonal hole extending through the center thereof parallel to the sleeve's longitudinal axis.

The sleeve has an externally threaded surface and is substantially closed on one end by a cap.

An elongated rod is provided having a first end slidably and non-rotatably enclosed within the sleeve and a second end extending therefrom, the first end having a polygonal cross-sectional shape the same as the cross-section of the hole. The first end is held in the sleeve by a threaded fastener, the rotation of which provides longitudinal adjustment of the rod.

The device is provided with spring means positioned between the closed end and the fastener, biasing the fastener and urging the second end of the rod from the sleeve. The cap has a hole in the end thereof sufficient to accommodate a tool adapted to turn the fastener.

DETAILED DESCRIPTION OF THE INVENTION

Figure 1:
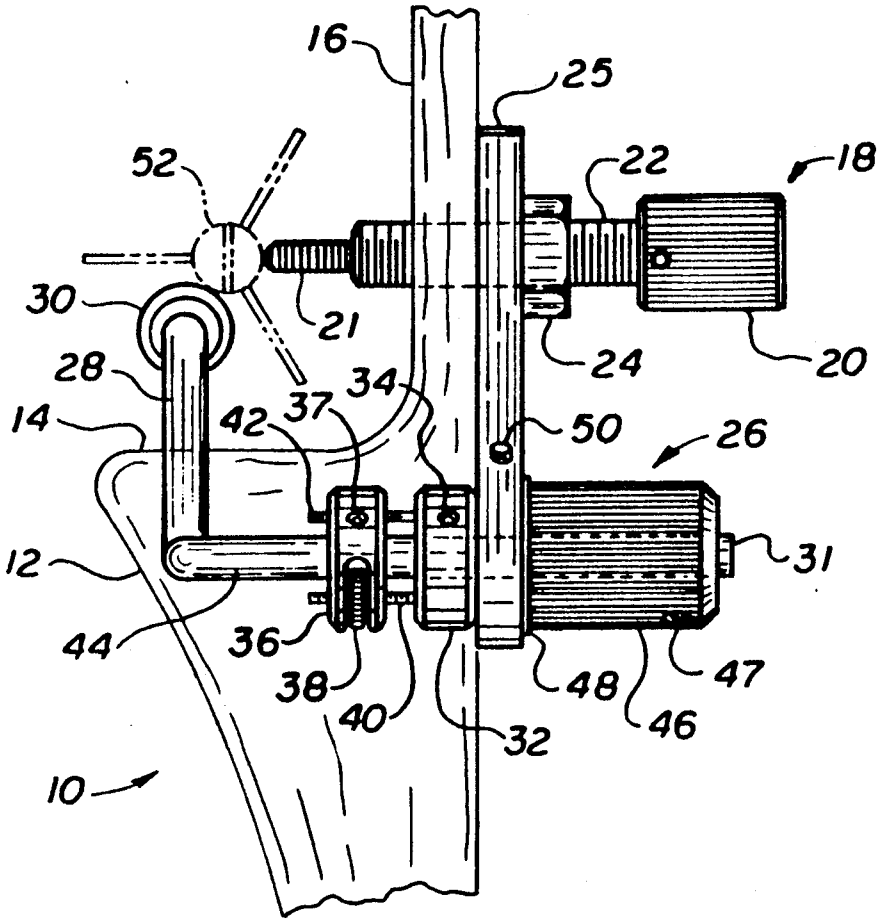
FIG. 1 is a rear elevation of the arrow rest and associated cushion plunger of the invention mounted on a bow.

FIG. 1 is a rear elevation of the arrow rest and associated cushion plunger of the invention mounted on a bow. The Figure shows an arrow rest, generally 26, in association with a cushion-plunger assembly, generally 18. The arrow rest comprises a support arm 28, with a roller 30 mounted thereon. Each time an arrow 52 is positioned on the roller 30, it rotates slightly, presenting a new surface for a subsequent arrow, thereby distributing wear on the roller. The support arm 28 includes the free end on which the roller is mounted as well as a fixed or pivot shaft end 44 passing through the sides of spacer disc 36, and attached thereto by means of a locking setscrew 37. The fixed end 44 also passes through the center of a bushing 31 and its associated shoulder 32, being connected thereto by locking setscrew 34. The bushing 31 is enclosed in a torque knob 46, being connected thereto by locking setscrew 47. A washer 48 separates the torque knob 46 from a mounting bracket side plate 25. Extending from bushing shoulder 32 are two studs, 40 and 42, respectively, the former being threaded and engaged by an adjustment wheel or nut 38 recessed in the spacer disc 36. A support arm elevation screw 50 is threaded into mounting bracket side plate 25.

The cushion plunger assembly 18 passes through the mounting bracket side plate 25 connecting it to the side wall riser 16 of the bow by means of a threaded plunger mounting shaft, or body 22. A lock nut 24 secures the body of the cushion plunger to the riser. A cushion plunger knob 20 substantially encloses one end of the hollow plunger body 22, while a plunger rod 21 extends from the other end thereof.

As will be explained in greater detail in the following, both the cushion plunger 18 and the arrow rest 26 allow adjustments to be made to arrows placed over the bow shelf 14 in a "shoot-through" arrangement.

While the dimensions of the support arm 28 will vary, depending upon the dimensions of the bow including that of the riser grip 12 and the bow shelf 14, generally, the free end of the arm, typically positioned at about 90° to the fixed end 44, will be from about 1 to 2½ inches long, and the fixed end will also be from about 1 to 2½ inches in length. The studs 40 and 42 will ordinarily have a length sufficient to accommodate an adjustment in the lateral movement of the fixed end 44 of about ⅛ to 1 inch.

Figure 2:
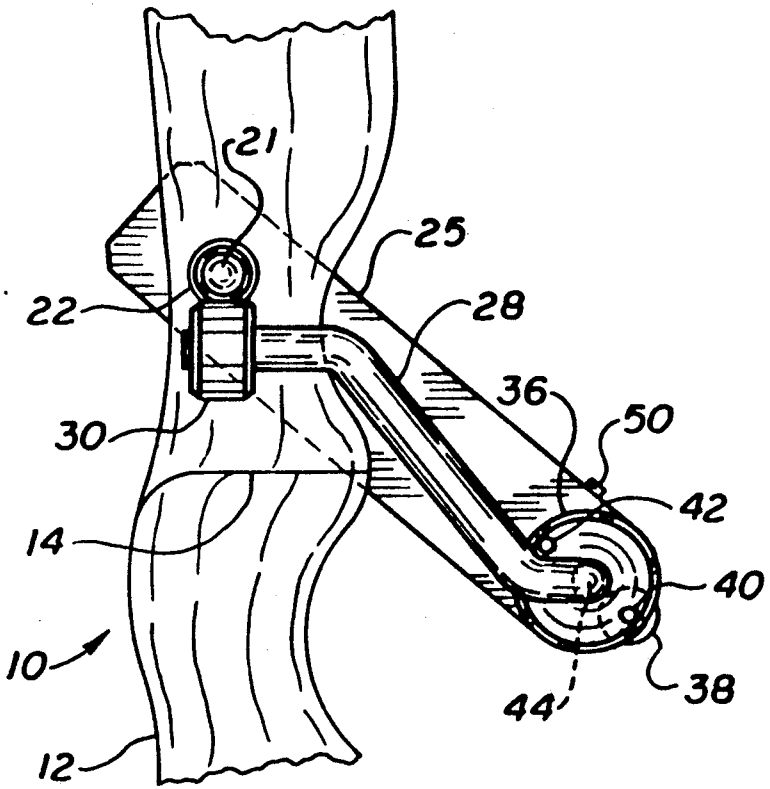
FIG. 2 is a left side elevation of the combination shown in FIG. 1.

FIG. 2 is a left side elevation of the combination shown in FIG. 1. As illustrated, further details of the positioning of the support arm 28 with its roller 30, relative to the plunger rod 21 enclosed in the plunger body 22 can be seen. Both are positioned over bow shelf 14, at the top of the riser grip 12.

Also shown is the spacer disc 36 the center of whose sides is penetrated by the fixed end 44 of support arm 28, the disc being movable by the rotation of adjustment wheel 38, allowing it to move laterally along the studs 40 and 42. A support arm elevation screw 50 is provided in the mounting bracket side plate 25 as shown. The elevation screw 50 allows the support arm 28 to be moved to any position desired within an arc of up to about 20°.

Figure 3:
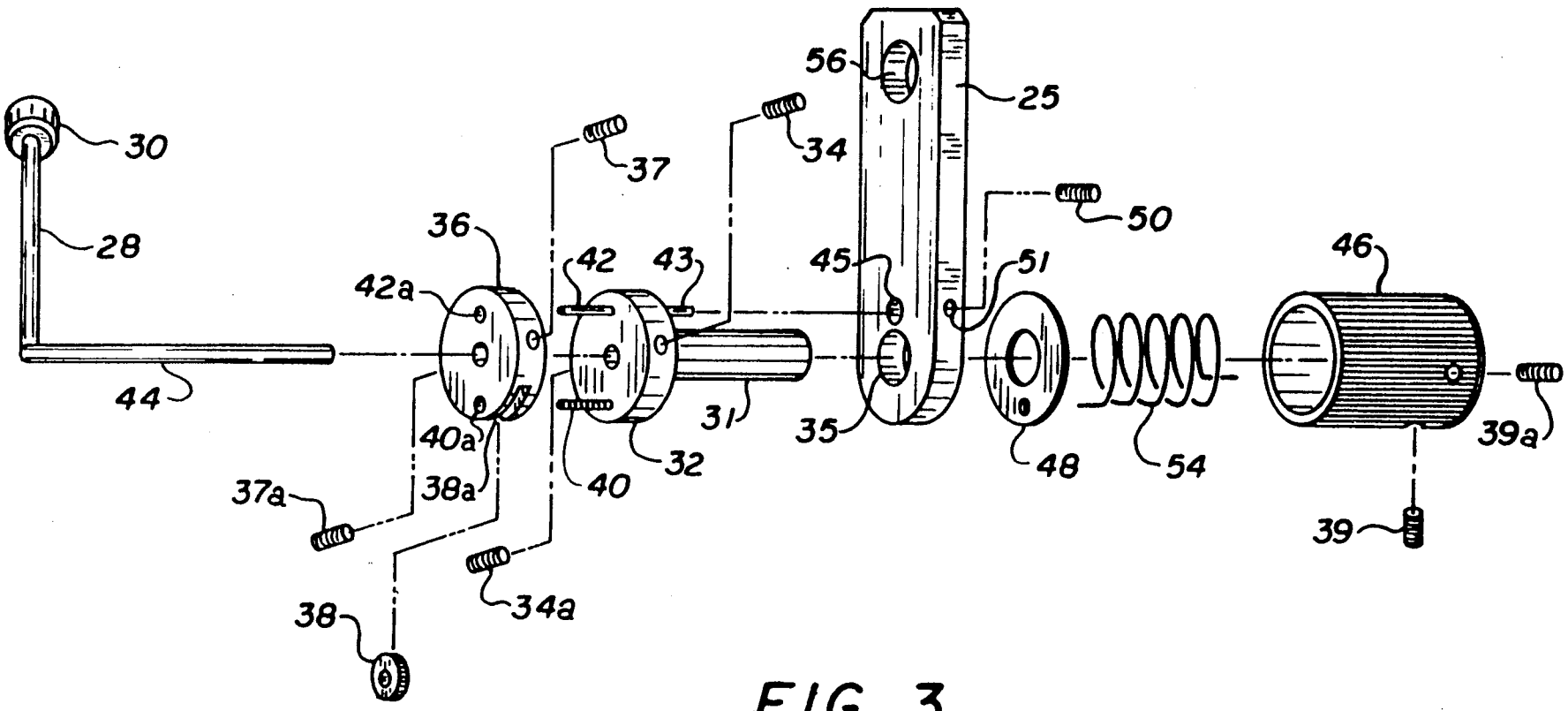
FIG. 3 is an exploded view of the arrow rest of the invention.

FIG. 3 is an exploded view of the arrow rest embodiment of the invention showing the support arm 28 including its roller 30 and the fixed end portion 44, the latter being adapted to be received through the center of the sides of spacer disc 36. When positioned in its desired location on fixed end 44, the disc is connected thereto by locking setscrews 37 and **37*a*, respectively. Stud ports 40*a* and 42*a* accommodate the threaded spacer stud 40 and the guide stud 42, the latter extending from shoulder 32 of bushing 31. Adjustment wheel 38, accommodated in recess 38*a*, receives the threaded spacer stud 40, allowing adjustment of the distance between the spacer disc 36 and the bushing shoulder 32. Since the fixed end 44 is connected to the spacer disc 36, adjustment of the wheel 38 allows the support arm 28 to be moved closer or further away from bushing shoulder 32. When desirably positioned, the locking setscrews 34 and 34*a* hold the fixed end 44** firmly in position.

Extending from the other side of the bushing shoulder 32 is a further stud 43 which extends into the arc-limit hole 45 of mounting bracket side plate 25. The movement of bushing 31, which is free to rotate within hole 35 of the bracket 25, is thus limited by the interior surfaces of the arc limit hole 45. The height of the support arm 28 can therefore be raised or lowered, depending on the extent to which the support arm elevation screw 50, extending through access hole 51 into the arc limit hole 45, is inserted.

A washer 48 separates the mounting bracket side plate 25 from a hollow torque knob 46. One end of the spring 54 passes through washer 48 into an anchoring hole in mounting bracket side plate 25, not shown. The other end of the spring is anchored in a hole located within torque knob 46, also not shown. The support arm 28 can be biased to the extent desired by rotating the torque knob 46 to the corresponding tension, and locking it into position by the insertion of locking setscrews 39 and **39*a***.

When a compensating adjustment in the lateral position of the support arm 28 is desired, locking setscrews 37, **37*a*, 34 and 34*a* are loosened and the adjustment wheel 38 is rotated. When the desired position of support arm 28** is achieved, the locking setscrews are tightened.

Gross adjustments of the elevation of the support arm 28 are achieved by rotating the mounting bracket side plate 25 within its mounting hole 56. Fine adjustments, however, are accomplished by screwing support arm elevation screw 50 into the access hole 51, thereby limiting the amount that the stud 43 can rotate within arc limit hole 45.

The force exerted by support arm 28 against an arrow is adjusted by loosening locking setscrews 39 and **39*a*, rotating torque knob 46 to tension spring 54** to the degree desired, after which the locking setscrews are again tightened.

The materials of construction of the arrow rest components will desirably be of metal, for example, steel, although other metals may also be used. It has been found desirable, however, to make the washer 48 from a plastic material, for instance nylon or a Teflon-filled acetal resin.

The roller 30 will desirably be formed from a high-melt plastic such as Teflon, or some similar material, the use of which assures both a quite launch and resistance to frictional heat generated by passage of the arrows.

Figure 4:
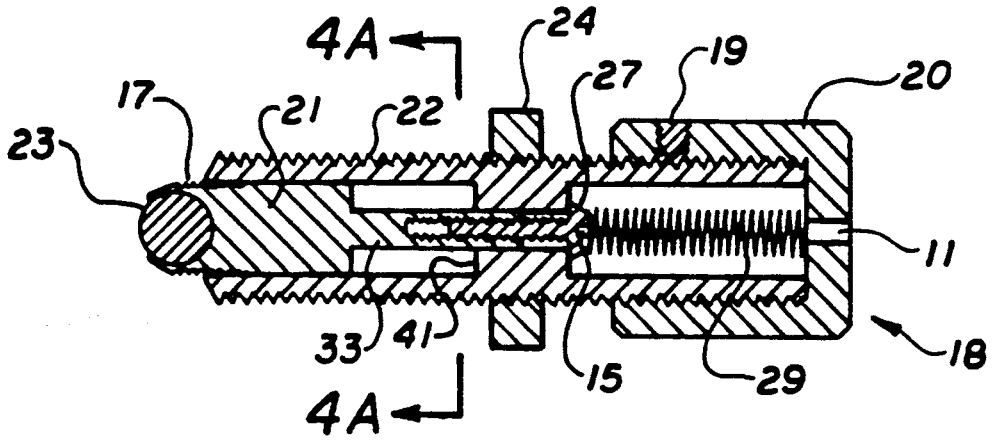
FIG. 4 is a longitudinal cross-section taken through the center of the cushion plunger embodiment of the invention.

FIG. 4 is a longitudinal cross-section of the cushion plunger embodiment of the invention. The Figure shows a cushion plunger of the invention 18 comprising an externally threaded plunger mounting shaft or body 22, one end of which has a plunger rod 21 extending therefrom, while the other end has a cushion plunger knob 20 located thereon. As shown, the plunger rod 21 has a ball bearing 23 mounted therein and a screw receiver 33, having a polygonal transverse cross-section, extending from the other end. The plunger body 22 has a partition wall 41 located in the center thereof penetrated by a hole with a polygonal transverse cross-section matching that of screw receiver 33 into which a plunger rod-adjusting screw 27 passes, being threaded into a corresponding hole in the end of the screw receiver. A plunger spring 29 is disposed between the head of the plunger adjustment screw 27 and the end of cushion plunger knob 20. A tool access slot 15 is located in the head of the plunger adjustment screw, and a torquing tool access hole 11 is provided in cushion plunger knob 20, the latter being fastened to the plunger body 22 by locking setscrew 19.

Gross lateral adjustments of the cushion plunger assembly are made by threading the plunger body 22 further into or out of the side wall riser 16, locking it in position by means of lock nut 24. Fine adjustments, however, are made by inserting an adjustment tool such as a screw driver, allen wrench, or the like through tool access slot 11 and into slot 15 of plunger rod-adjustment screw 27. Since screw receiver 33 cannot rotate within partition wall 41, rotation of the plunger adjustment screw forces plunger rod 21 either in or out of the end of plunger body 22, depending upon which direction the tool is rotated. Calibration grooves 17 provide a visual indication of the amount of adjustment accomplished. Spring 29, urging against the head of plunger adjustment screw 27 maintains the plunger rod 21 in the position of extension selected.

In a preferred embodiment and in order to maintain the adjustment made, it has been found desirable to coat the threads of plunger rod-adjustment screw 27 with a high friction substance, for example, as nylon, Teflon, or any of a variety of other plastic substances, or a hot-melt glue.

The screw receiver 33 and the counterpart hole in partition wall 41 can be any suitable transverse shape which prevents rotation of the former within the latter, including polygonal shapes such as square, hexagonal, or others. However, additional shapes can also be used that have parameters lying at varying distances from the center thereof.

The nature of the exposed tip of plunger rod 21 will depend upon the use to which the bow is to be put. In target shooting, for instance, it has been found particularly useful to provide a freely rotatable ball bearing for the purpose. However, since the passage of arrows against the metal surface of the ball bearing tends to be audible, in those instances when the bow is to be used for hunting, it will often be found desirable to affix a Teflon-filled acetal resin tip since such a composition, or equivalent compositions, provide low noise, as well as low friction when arrows are shot in contact therewith.

The dimensions of the cushion plunger can be varied within broad limits, depending upon the dimensions of the bow with which the cusion plunger is used. Often, however, the plunger body 22 will be from about 1½ to 2 inches long, and will have a diameter of approximately ⅛ to ¼ of an inch. The partition wall will typically vary from about ½ to about ¾ inch, while the plunger rod will have a length of from about 1 to 1½ inches in length. The internal diameter of the plunger body will be about ⅛ inch in diameter.

Figure 4A:
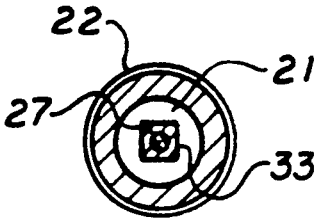
FIG. 4A is a cross-sectional view along line 4A—4A of FIG. 4.

FIG. 4A is a cross-sectional view along 4A—4A of FIG. 4. The Figure shows the plunger rod 21 inserted in plunger body 22 and illustrates how the polygonal shape of the screw receiver 33, in the case of the Figure a square, prevents rotation of the plunger rod when it is inserted in the corresponding hole in the partition wall 41 and the plunger rod-adjustment screw 27 is rotated within the receiver.

The cushion plunger assembly can be made of various metals including brass, steel, or others.

Figure 5:
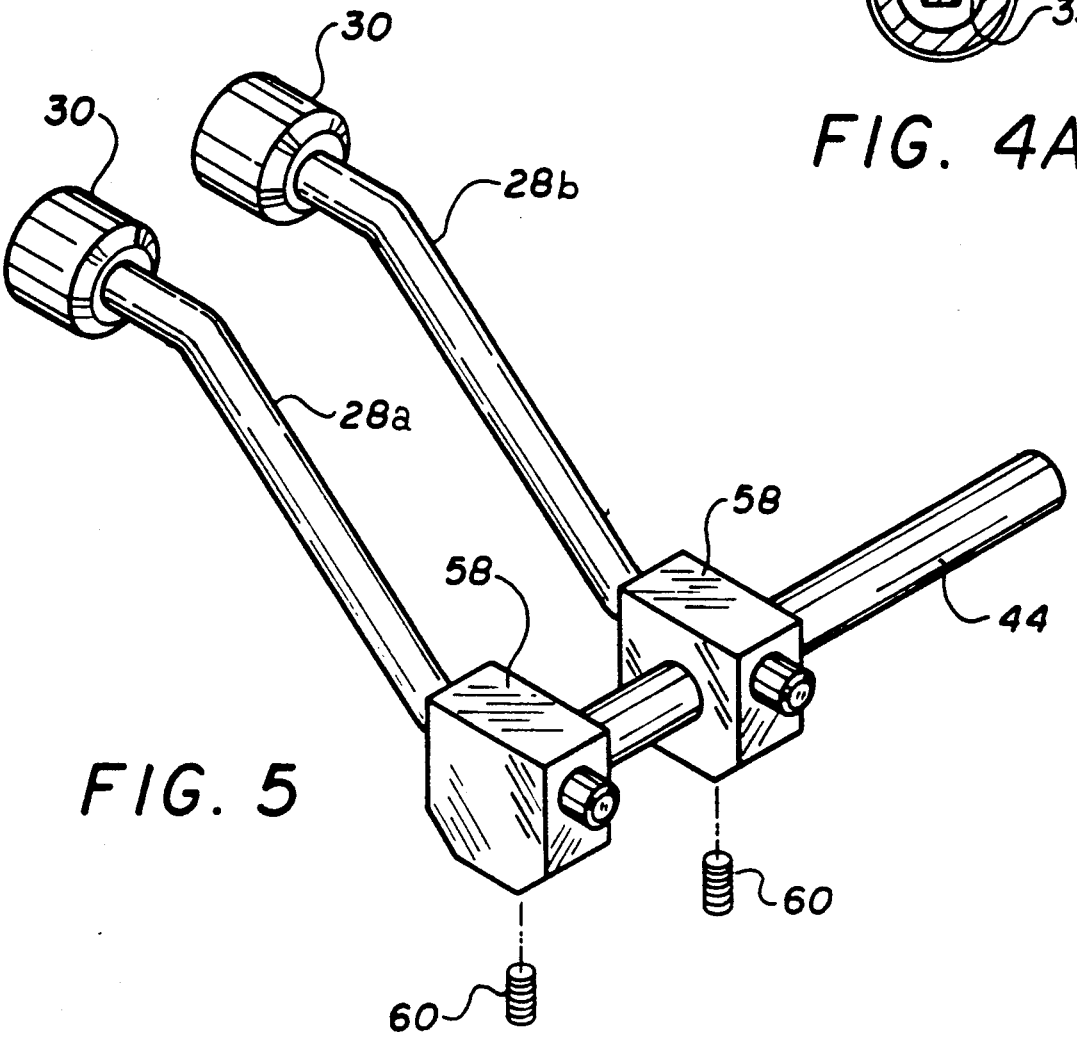
FIG. 5 is an isometric partial view of another embodiment of the support arm portion of the arrow rest of the invention.

FIG. 5 is an isometric partial view of another embodiment of the support arm portion of the arrow rest of the invention. The embodiment represents a "center-shot" configuration of the arrow rest, one which is not used in conjunction with the cushion plunger of FIG. 4. As shown, two support arms are provided, 28*a* and 28*b*, being connected to the fixed end of the support arm by means of support arm pivot blocks 58. The support arms may be moved further apart or closer together, as desired, by pivoting them within the blocks, locking the arms in position by locking setscrews 60.

While rollers 30 are shown mounted on the ends of the support arms, the ends of the arms may be curved downwardly in a "hooked" configuration, if desired, and the rollers dispensed with. Again, while the rollers are quieter and particularly suited for hunting purposes, the hooked configuration is eminently suitable for target shooting.

The diameter of the fixed end of the rest arms will commonly be from about ⅛ to ¼ of an inch in diameter, while the portion of the support arm at right angles thereto will be about 3/32 inch in diameter.

While in accordance with the patent statutes, a preferred embodiment and best mode has been presented, the scope of the invention is not limited thereto, but rather is measured by the scope of the attached claims.

What is claimed is:

1. An adjustable arrow rest device for an archery bow comprising an arrow support arm having a fixed end and two free ends positioned at an angle to said fixed end pivotable through an arc, said device having a bracket adapted to connect it to said bow, and said fixed end being interconnected with a spacer disc and with torquing means, said torquing means comprising a bushing into which the fixed end of said support arm passes and to which it is connectable, said bushing passing through said bracket and being adjustably rotatable therein through an arc, said bushing extending into a hollow knob to which it is adjustably connected, a spring being positioned in an annular space between said knob and said bushing with one of its ends being anchored in said bracket and the other in said knob, said bushing being provided with a shoulder having a stud extending from one side thereof into an opening in said bracket, movement of said stud and said opening being adjustably limited by a setscrew extending thereinto, said shoulder also having two studs, one threaded, extending from the other side thereof, said fixed end passing through the center of the sides of said spacer disc to which it is connectable, the said two studs also passing through said sides with the threaded stud engaging a support arm lateral-position-adjustment nut recessed in the edge of said disc.

2. An adjustable, arrow-launch stabilizing assembly for an archery bow, said assembly including an arrow rest device for supporting an arrow, the arrow having a longitudinal axis in a horizontal plane, and a cushion plunger device, said arrow rest device comprising:

arrow support means being laterally adjustable to provide vertical support to an arrow on said arrow rest device, said support means having a free end and a fixed end, said free end being positioned at an angle to said fixed end with respect to the longitudinal axis of said fixed end, and being pivotable to stabilize in the vertical direction the bending of an arrow being launched from the bow;

torquing means connected with said fixed end, said torquing means having first spring means for exerting biasing force on said fixed end, and spring adjusting means for adjusting said biasing force to a desired value to effect said stabilization;

spacer means operatively connected to said fixed end of said arrow support means for moving said free end to a fixed lateral position to move laterally the longitudinal axis of an arrow on said rest device; and mounting means for mounting said arrow rest device and said cushion plunger device, and said cushion plunger device comprising means for stabilizing horizontal bending of an arrow being launched from the bow.

3. An assembly according to claim 2 wherein adjustable means are provided to limit the arc through which said support arm can pivot.

4. An assembly according to claim 2 in which said mounting means is a bracket, and said torquing means comprises a bushing into which the fixed end of said support arm passes and is connectable, said bushing passing through said bracket and being adjustably rotatable therein through said arc, said bushing extending into a hollow knob to which it is adjustably connected, said first spring means comprising a spring being positioned in an annular space between said knob and said bushing, one of its ends being anchored in said bracket and the other in said knob, whereby before the bushing and knob are interconnected, the knob can be rotated until said spring is sufficiently tensioned to provide a desired torque on said fixed end.

5. An assembly according to claim 4 in which said bushing is provided with a shoulder having a stud extending from one side thereof into an opening in said bracket, contact of said stud with surfaces of said opening during rotation of said bushing defining the magnitude of said arc.

6. An assembly according to claim 2 in which the partition in said sleeve has a polygonal hole extending through the center thereof parallel to the sleeve's longitudinal axis and the transverse cross-section of said first end has the same polygonal shape.

7. An assembly according to claim 6 in which the external surface of said sleeve is provided with threads, and said closed end comprises a threaded cap fastened to said sleeve having a hole in the end thereof sufficient to accommodate a tool adapted to turn said fastener.

8. An assembly according to claim 7 in which the threads of said fastener are coated with a substance selected from the group consisting of a hot-melt adhesive, and a plastic.

9. An assembly according to claim 8 in which the second end of said rod has a ball bearing mounted therein.

10. The invention according to claim 2 wherein said cushion plunger device comprises:

hollow sleeve means having an open end and a substantially closed end adapted to fasten said stabilizing assembly to said archery bow;

rod means having first and second ends and being movable within said hollow sleeve means, said first end extending into said hollow sleeve means and said second end extending from said open end;

movable fastener means enclosed in said hollow sleeve means and operatively engageable with said first end of said rod means, movement of said fastener providing longitudinal adjustment of said rod relative to said hollow sleeve means, and second spring means positioned between said substantially closed end and said fastener means to urge said second end from said hollow sleeve means and provide stabilization of an arrow in the horizontal direction.

11. The invention according to claim 10 wherein said hollow sleeve means comprises a hollow sleeve with a partition therein, said substantially closed end providing accessway to a tool, said sleeve being adapted to fasten said stabilizing assembly to said archery bow;

said rod means comprises a non-rotatable, slidable, elongated rod enclosed within said hollow sleeve means, said first end extending into said partition, and said second end extending from said open end;

said movable fastener means comprises a fastener threaded into said first end of said rod, rotation of said fastener by said tool providing longitudinal adjustment of said rod means relative to said hollow sleeve means, and said second spring means comprises a second spring positioned between said closed end and said movable fastener means for biasing said movable fastener means to urge said second end from said hollow sleeve means.

12. An adjustable, arrow-launch-stabilizing assembly for an archery bow comprising an arrow rest device and a cushion plunger device, wherein said arrow rest device comprises:

an arrow support arm having a free end and a fixed end, said free end being positioned at an angle to said fixed end and being pivotable through an arc;

a mounting bracket having an opening therein and adapted to fasten said arrow rest device to said cushion plunger device;

adjustable means to vary the size of said opening;

torquing means attached to said mounting bracket, said torquing means comprising:

a bushing provided with a shoulder;

first stud means extending from one side of said shoulder into the opening of said mounting bracket, contact of said stud means with surfaces of said opening during rotation of said bushing defining the magnitude of said arc, said fixed end of said support arm passing through said bushing and being connected to said support arm, and said bushing passing through said bracket and being adjustably rotatable therein through said arc; and knob means adjustably connected to said torquing means for establishing the biasing force which said torquing means exerts on said fixed end;

threaded adjustment means for adjusting the lateral spacing of said device;

first spring means comprising a spring having two ends positioned in an annular space between said knob means and said bushing, one of the ends of said first spring means being anchored in said bracket, and the other end in said knob means, said first spring means providing said desired biasing force;

spacer means being adapted to adjust the lateral position of said free end relative to said torquing means by rotation of said threaded adjustment means, wherein before said bushing and said knob means are interconnected, the knob means is rotated until said spring is sufficiently tensioned to provide the desired biasing force on said fixed end, and wherein said cushion plunger device comprises:

a threaded fastener;

a hollow sleeve with a partition therein and having an open end, and a substantially closed end providing accessway to a tool for rotating said fastener, said hollow sleeve being adapted to fasten said mounting bracket to said bow; and a non-rotatable, slidable, elongated rod having first and second ends and being enclosed within said hollow sleeve, said second end extending from said open end and said first end extending into said partition and being held by said threaded fastener, rotation of said fastener providing longitudinal adjustment of said rod relative to said hollow sleeve, and second spring means positioned between said closed end and said fastener which biases said fastener to urge said second end from said sleeve.

13. An assembly according to claim 12, wherein said adjustable means comprises a set screw extending into said opening.

14. An assembly according to claim 13 in which stud second means extends from the other side of said shoulder, said spacer means comprising a disc having sides through whose center said fixed end passes, and is connectable, said first and second stud means also passing through the sides of said disc, and said second stud means engaging an adjustment nut recessed in said disc for laterally positioning said support arm.

15. An adjustable arrow-stabilizing rest device for an archery bow comprising:

a mounting bracket with an opening, adapted to fasten said arrow rest to a bow;

a hollow knob;

adjustment means for adjusting the lateral spacing of said device;

spring means for biasing said device;

an arrow support arm having at least one free end, and a fixed end, said free end being positioned at an angle relative to said fixed end and being pivotable through an arc;

torquing means interconnected with said arrow support arm and attached to said mounting bracket for exerting a desired biasing force on said fixed end through adjustment of tension in said spring means, wherein said torquing means comprises a bushing into which the fixed end of said support arm passes and is connectable, said bushing being provided with a shoulder having first stud means extending from one side thereof into said bracket opening, contact of said stud means with surfaces of said opening during rotation of said bushing defining the magnitude of said arc, said bushing passing through said mounting bracket and being adjustably rotatable therein through said arc, and said bushing extending into said hollow knob to which it is adjustably connected, said spring means comprising a spring having two ends positioned in an annular space between said hollow knob and said bushing, one of the ends of said spring being anchored in said mounting bracket, and the other end in said hollow knob, wherein before the bushing and said hollow knob are interconnected, the hollow knob is rotated until said spring is sufficiently tensioned to provide the desired biasing force on said fixed end; and adjustable means to vary the size of said opening and the magnitude of said arc, and spacer means interconnected with said fixed end and adapted to determine the lateral position of said free end by adjustment of said adjustment means.

16. A device according to claim 15 wherein said adjustable means comprises a setscrew extending into said opening.

17. A device according to claim 15 in which said shoulder has second stud means extending from the other side of said shoulder, said spacer means comprising a disc having sides through whose center said fixed end passes and is connectable, said first and second stud means also passing through the sides of said disc, and said second stud means engaging an adjustment nut recessed in said disc for laterally positioning said support arm.

18. An adjustable arrow-stabilizing rest device for an archery bow, comprising:

mounting means adapted to fasten said arrow rest to said bow;

an arrow support arm having at least one free end, and a fixed end, said free end being positioned at an angle to said fixed end and being pivotable;

torquing means including adjustable spring means for exerting a desired biasing force on said fixed end;

means for adjusting the free end to a fixed lateral position, comprising:

a laterally extending threaded member anchored to said arrow rest;

spacer means achored to said arrow support arm;

threaded adjustment means mounted on said threaded member and interconnected with said spacer means such that rotation of said threaded adjustment means causes lateral movement of said threaded adjustment means, the interconnected spacer means, and said free end.

19. A device according to claim 18 wherein adjustable means are provided to limit the arc through which said free end can pivot.

20. A device according to claim 18 in which said support arm has a fixed end and two free ends positioned at an angle to said fixed end.

21. A device according to claim 18 which also includes knob means, said mounting means being a bracket, and said torquing means comprising a bushing into which the fixed end of said support arm passes and is connectable, said bushing passing through said bracket and being adjustable rotatable therein, said bushing also extending into said knob means to which it is adjustably connected, and said spring means comprising a spring with two ends positioned in an annular space between said knob means and said bushing, one of the spring ends being anchored in said bracket, and the other end in said knob means, wherein before the bushing and said knob means are interconnected, the knob means is rotated until said spring is sufficiently tensioned to provide the desired torque on said fixed end and then connected to said bushing.

22. A device according to claim 21 in which said bushing is provided with a shoulder having a stud extending from one side thereof into an opening in said bracket, contact of said stud with surfaces of said opening during rotation of said bushing defining the magnitude of said arc.

23. A cushion-plunger arrow-stabilizing device for an archery bow comprising:

hollow sleeve means adapted to pass through said archery bow and to be fastened thereto, said hollow sleeve means having an open end, a substantially closed end, and a partition between said open and closed ends, said partition including a through passage from said open end to said closed end;

an elongated rod having a first end with a hole extending thereinto, said hole having interior threads and being parallel to the rod's longitudinal axis, said rod being slidably and non-rotatably enclosed within said hollow sleeve means, and having a second end extending from said open end of said hollow sleeve means, said first end extending into said passage of said partition within said hollow sleeve means;

threaded fastener means for adjusting lateral positioning of said elongated rod, comprising a portion having screw threads on its surface, and a head of dimensions too large to enter said passage, said fastener means adjustably holding said elongated rod in said partition by the mating engagement of said screw threads on said threaded portion of said threaded fastener means and said interior threads of said hole; and spring means disposed between said substantially closed end of said hollow sleeve means and said head of said threaded fastener means, for biasing said head against an entrance to said passage, and for biasing said elongated rod toward said open end of said hollow sleeve means;

wherein rotation of said threaded fastener means in said hole provides longitudinal adjustment of said elongated rod.

24. A device according to claim 23 in which the partition in said sleeve has a polygonal hole extending through the center thereof parallel to the sleeve's longitudinal axis, and said second end has a polygonal transverse cross-sectional shape substantially the same as the shape of said hole.

25. A device according to claim 24 in which the external surface of said sleeve is threaded and said closed end comprises a threaded cap having a hole in the end thereof sufficient to accommodate a tool adapted to turn said fastener.

26. A device according to claim 24 in which the threads of said fastener are coated with a substance selected from the group consisting of a hot-melt adhesive and a plastic.

27. A device according to claim 26 in which the second end of said rod has a ball bearing mounted thereon.

28. A cushion-plunger arrow-stabilizing device for an archer bow comprising:

cap means having a hole in the end thereof;

hollow sleeve means with a partition therein having a hole with a non-circular, transverse cross section extending through the center thereof, said hollow sleeve means being open on one end and substantially closed on the other end by said cap means, said partition including a through passage from said open end to said closed end;

elongated rod means having a first end with a hole extending thereinto, said hole having interior threads and being parallel to the rod's longitudinal axis, said elongated rod means being slidably and non-rotatably enclosed within said hollow sleeve means and having a second end extending from said open end, said first end having a transverse cross-section substantially the same as that of said non-circular hole and extending into said passage of said partition within said hollow sleeve means;

threaded fastener means for adjusting the lateral positioning of said elongated rod means, comprising a portion having screw threads on its surface, and a head of dimensions too large to enter said passage, said threaded fastener means adjustably holding said elongated rod means in said hollow sleeve means by the mating engagement of said screw hole, said hole in the end of said cap means being sufficient to accommodate a tool adapted to adjust said threaded fastener means; and spring means positioned between said cap means and said head of the said threaded fastener means for biasing said head against an entrance to said passage and for biasing said second end of said elongated rod means toward the open end of said hollow sleeve means.

* * * * *